US005460100A

United States Patent [19]

Gowda et al.

[11] Patent Number: 5,460,100

[45] Date of Patent: Oct. 24, 1995

[54] SERVICE BYPASS APPARATUS FOR AUTOMATIC DOOR OPERATOR ON A PASSENGER RAILWAY VEHICLE

[75] Inventors: Padmanab L. Gowda; Daniel Brillant, both of Greer, S.C.

[73] Assignee: Westinghouse Air Brake Company, Wilmerding, Pa.

[21] Appl. No.: 249,710

[22] Filed: May 26, 1994

[51] Int. Cl.[6] ..... B61D 19/00

[52] U.S. Cl. ..... 105/341; 49/24; 49/49

[58] Field of Search ..... 105/341, 348, 105/349; 49/24, 49, 139, 141; 70/D30, 256, 257, 277; 200/533, 558, 573, 574, 330, 336–338, 43.01, 43.08, 43.09, 51.09, 61.58 R; 116/202

[56] References Cited

U.S. PATENT DOCUMENTS 2,459,029 1/1949 Ingres et al. ..... 49/24
3,733,861 5/1973 Lester ..... 70/277
4,526,264 7/1985 MacNamara et al. ..... 194/1 N

*Primary Examiner*—Robert J. Oberleitner
*Assistant Examiner*—S. Joseph Morano
*Attorney, Agent, or Firm*—James O. Ray, Jr.

[57] ABSTRACT

A service bypass apparatus for isolating a door from an automatic door operator on a passenger transit type railway vehicle, and lock such door in a closed position, which includes a partially rotatable shaft having a blocking lever arm rigidly secured to the rotatable shaft which can be pivoted into a position sufficient to block the door from opening. The shaft is also provided with at least one cam adapted to operate at least one switch which will electrically and pneumatically isolate the door from the automatic door operator, and activate whatever bypasses are necessary to permit other door operators to function in their normal manner. A remote control apparatus is also provided which includes a partially rotatable cylinder with a closed-loop cable interconnecting the rotatable cylinder and the shaft, so that any partial rotation of the cylinder will cause a partial rotation of the shaft as necessary to isolate the door from the automatic door operator.

20 Claims, 6 Drawing Sheets

SERVICE BYPASS APPARATUS FOR AUTOMATIC DOOR OPERATOR ON A PASSENGER RAILWAY VEHICLE

FIELD OF THE INVENTION

The present invention relates generally to a service bypass apparatus for an automatic door operator on a passenger transit type railway vehicle. More particularly, this invention relates to a simple and reliable apparatus to isolate any one or more particular doors mechanically, electrically and pneumatically from it's automatic door operator on a passenger transit type railway vehicle and hold the door or doors in the closed position. The apparatus includes an automatic reset which, nevertheless, allows the isolated door or doors to be pushed open in emergency situations, and reconnects the door or doors mechanically, electrically and pneumatically to the automatic door operator for normal operation.

BACKGROUND OF THE INVENTION

It is generally well known, in the art, that the access doors on passenger transit railway vehicles, such as subway cars and the like, are provided with individual automatic door operators which function to open and close each door or pair of doors so that passengers can have access to and from the vehicle. All automatic door operators are normally activated in unison by a door opening and closing control mechanism at the hand of the vehicle operator. Typically, such an automatic door operator is driven by a hydraulic or pneumatic cylinder or an electric motor, which is connected to an overhead linkage or driving mechanism adapted to open and close the door or doors in response to the reciprocating action of the hydraulic or pneumatic cylinder rod or the rotating action of the electric motor.

It is sometimes necessary, however, to isolate a given door from its associated automatic door operator in order to keep the door in the closed position when the other doors are opened to permit passengers to ingress or egress. For example, a particular door operator mechanism may be faulty, or some other safety considerations may require that passengers not have access through a given particular door for any one of a number of reasons. Prior art techniques for isolating an access door usually involve a time consuming and complex effort of disconnecting of the door from the automatic door operator, and locking the door in place. Normally, a door so disconnected and locked in the closed position, cannot be opened by the emergency door opening mechanism, which can lead to a hazardous condition.

SUMMARY OF THE INVENTION

The present invention is predicated upon the development of a new and unique service bypass apparatus for use on an automatic access door operator on a passenger transit type railway vehicle that will quickly and reliably isolate the access door mechanically, electrically and pneumatically from it's associated automatic access door operator and virtually lock such access door in the closed position. The apparatus is designed to be activated and deactivated by a simple turn of a key, or it can be quickly deactivated by a passenger without a key by simply pulling on an emergency release.

In its basic form the apparatus of this invention utilizes a blocking lever arm secured at the end of a partially rotatable shaft. A partial rotation of the shaft will position the blocking lever arm against a flange or other abutment attached to the door panel so that the door panel will not open. One or more cam means are also secured on the rotatable shaft and positioned so that the same partial rotation of the rotatable shaft will cause the cam means to activate one or more switch means that will isolate the automatic door operator electrically and pneumatically from other door operators, that will disconnect the automatic door operator from a trainline interlock circuit, and if desired, light an "Out of Service" light above or adjacent to the door panel. A key operated remote control apparatus is provided to partially rotate the shaft as necessary to simultaneously pivot the blocking lever arm into a position sufficient to block the door from opening, and also pivot the one or more cam means into position sufficient to activate the one or more switch means. When the shaft is rotated back to its original position, the blocking lever arm is moved back out of the way, the switch means are inactivated, and the door is restored to its normal operating condition. Either operation can be effected by a simple turn of a key, or in the case of an emergency, the shaft can be returned to its original position by pulling an emergency cable.

OBJECTS OF THE INVENTION

It is, therefore, one of the primary objects of the present invention to provide a simple, reliable, low cost and easy to operate, service bypass apparatus for an automatic door operator on a passenger transit type railway vehicle which will isolate the door panel mechanically, electrically and pneumatically from it's associated automatic door operator and hold the door panel in the closed position, as may be necessary to prevent the isolated door from opening when the automatic door operators are activated to open all other doors.

Another object of the present invention is to provide a simple, reliable, low cost and easy to operate, service bypass apparatus for an automatic door operator on a passenger transit type railway vehicle which is mechanical in nature and does not require any energy to keep the isolated door in the closed and locked position.

A further object of the present invention is to provide a simple, reliable, low cost and easy to operate, service bypass apparatus for an automatic door operator on a passenger transit type railway vehicle which can be remotely operated without direct access to the automatic door operator itself.

An even further object of the present invention is to provide a simple, reliable, low cost and easy to operate, service bypass apparatus for an automatic door operator on a passenger transit type railway vehicle which can be adapted to practically any automatic door operator system and readily modified to meet a variety of requirements.

A still further object of the present invention is to provide a simple, reliable, low cost and easy to operate, service bypass apparatus for an automatic door operator on a passenger transit type railway vehicle which can be readily retrofit to practically any existing automatic door operator and readily modified to meet any requirement.

A still further object of the present invention is to provide a simple, reliable, low cost and easy to operate, service bypass apparatus for an automatic door operator on a passenger transit type railway vehicle which can be remotely operated by a simple control device located within the vehicle for easy access which can be positioned at any one of a number of different convenient locations within the vehicle.

Still an additional object of the present invention is to provide a simple, reliable, low cost and easy to operate, service bypass apparatus for an automatic door operator on a passenger transit type railway vehicle which can be remotely operated by a simple turn of a key.

An additional object of the present invention is to provide a simple, reliable, low cost and easy to operate, service bypass apparatus for an automatic door operator on a passenger transit type railway vehicle which can be remotely operated as noted above and yet can be simply reset.

An even further object of the present invention is to provide a simple, reliable, low cost and easy to operate, service bypass apparatus for an automatic door operator on a passenger transit type railway vehicle which can be remotely operated as noted above and yet can be simply reset without a key for emergency opening of the isolated door.

In addition to the above-described objects and advantages of the apparatus for isolating a door from the automatic door operator of this invention, various other objects and advantages of the present invention will become more readily apparent to those persons who are skilled in the same and related arts from the following more detailed description of the invention, particularly, when such description is taken in conjunction with the attached drawing figures and with the appended claims.

DESCRIPTION OF A PREFERRED EMBODIMENT OF THE INVENTION

Figure 1:
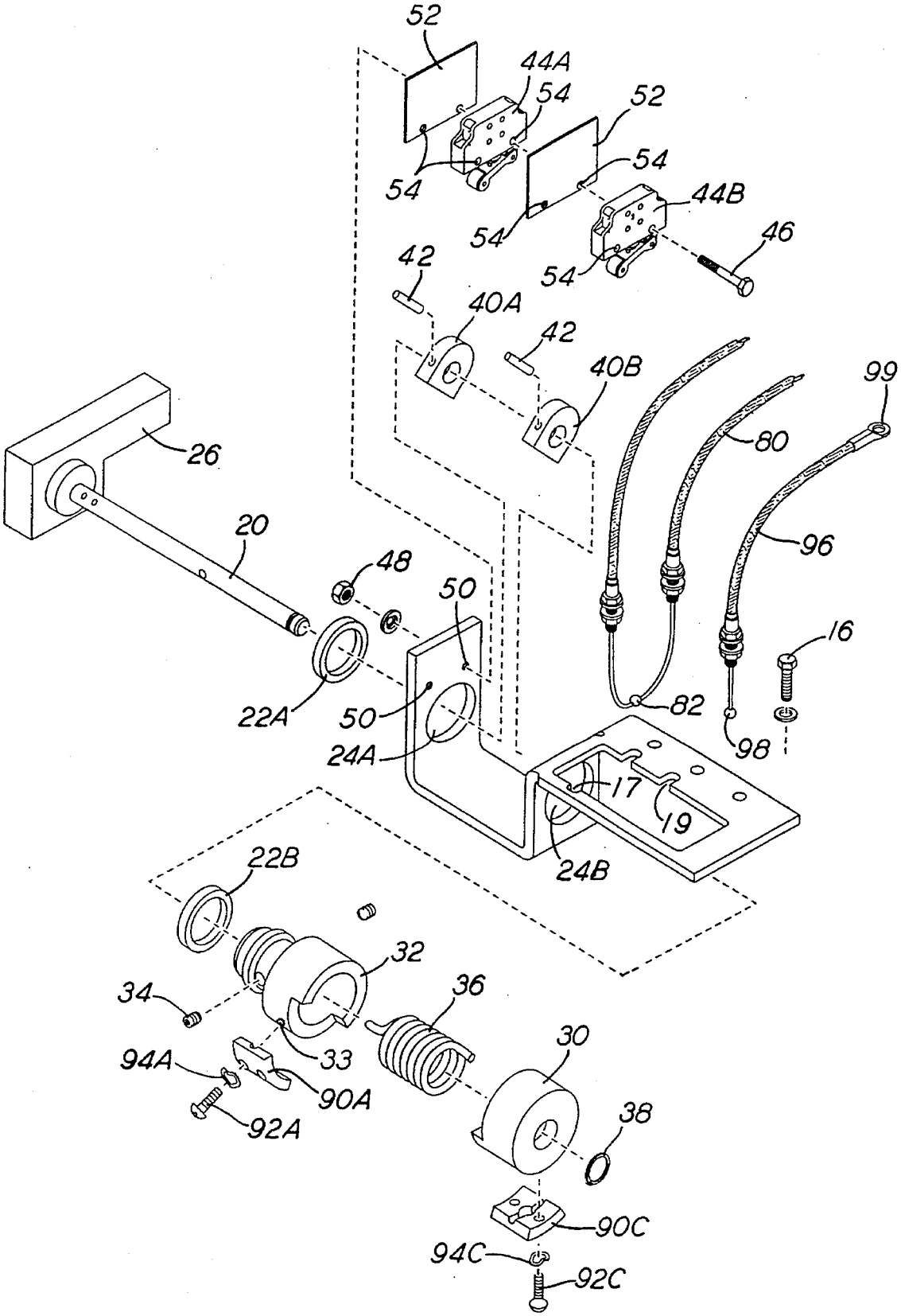
FIG. 1 is an exploded isometric view of the apparatus of one presently preferred embodiment of this invention for isolating an access door from it's associated automatic door operator and locking the door in the closed position.

Prior to proceeding with a more detailed description of the service bypass apparatus for an automatic door operator of this invention, it should be noted that throughout the several views illustrated in the attached drawings, identical components which have associated therewith identical functions have been identified with identical reference numerals for the sake of clarity.

Figure 7:
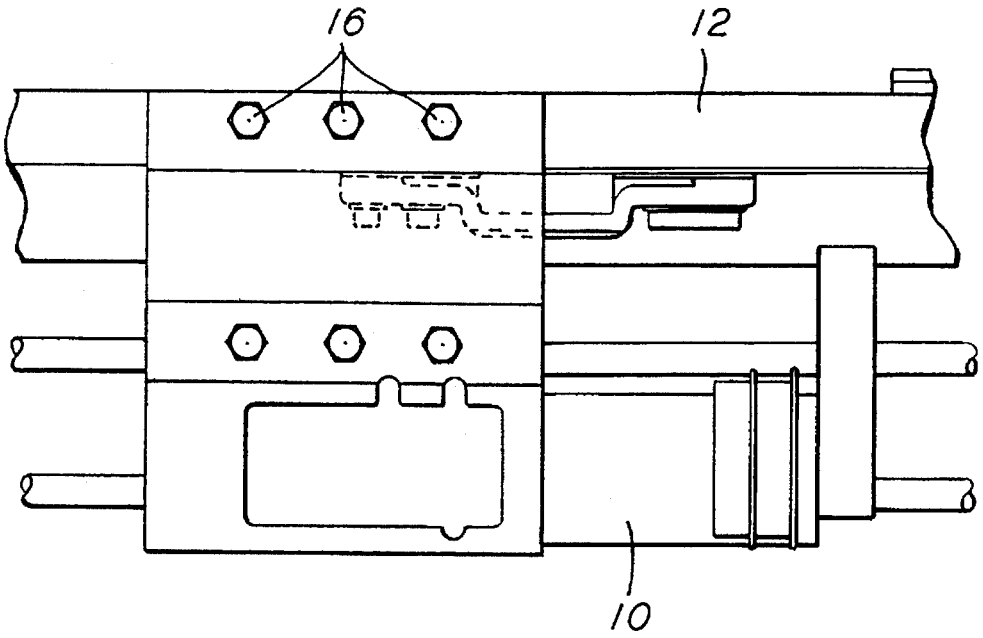
FIG. 7 is a plan view of substantially the same as FIG. 3, but showing the apparatus as mounted to an overhead automatic door operator.
Figure 8:
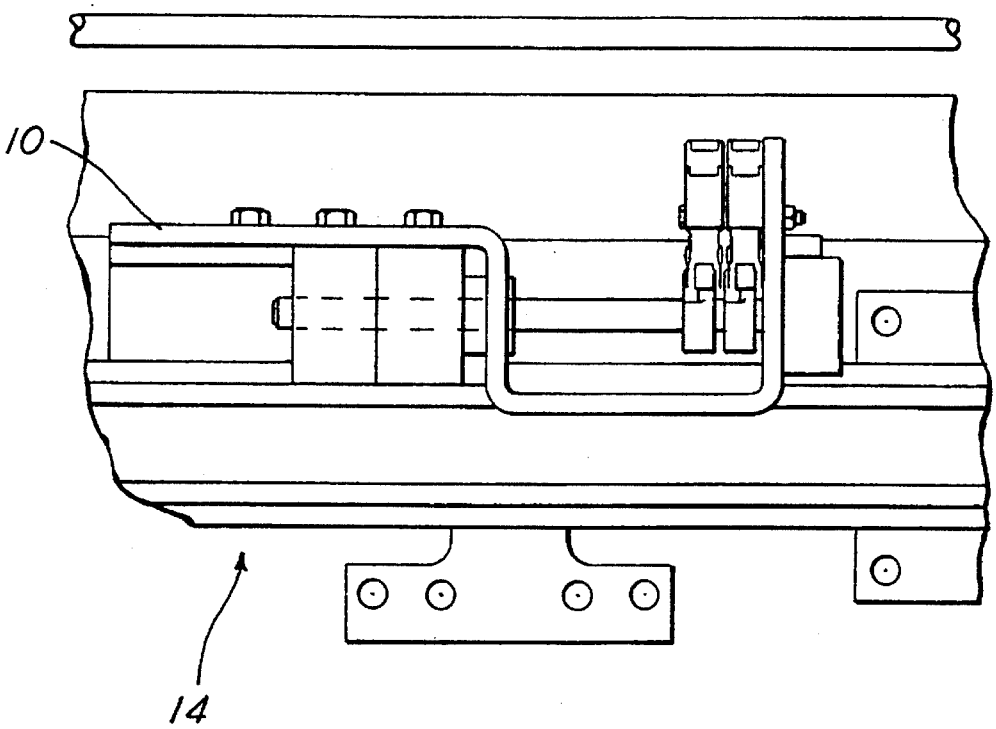
FIG. 8 is an elevational view of the apparatus as shown in FIG. 7.
Figure 9:
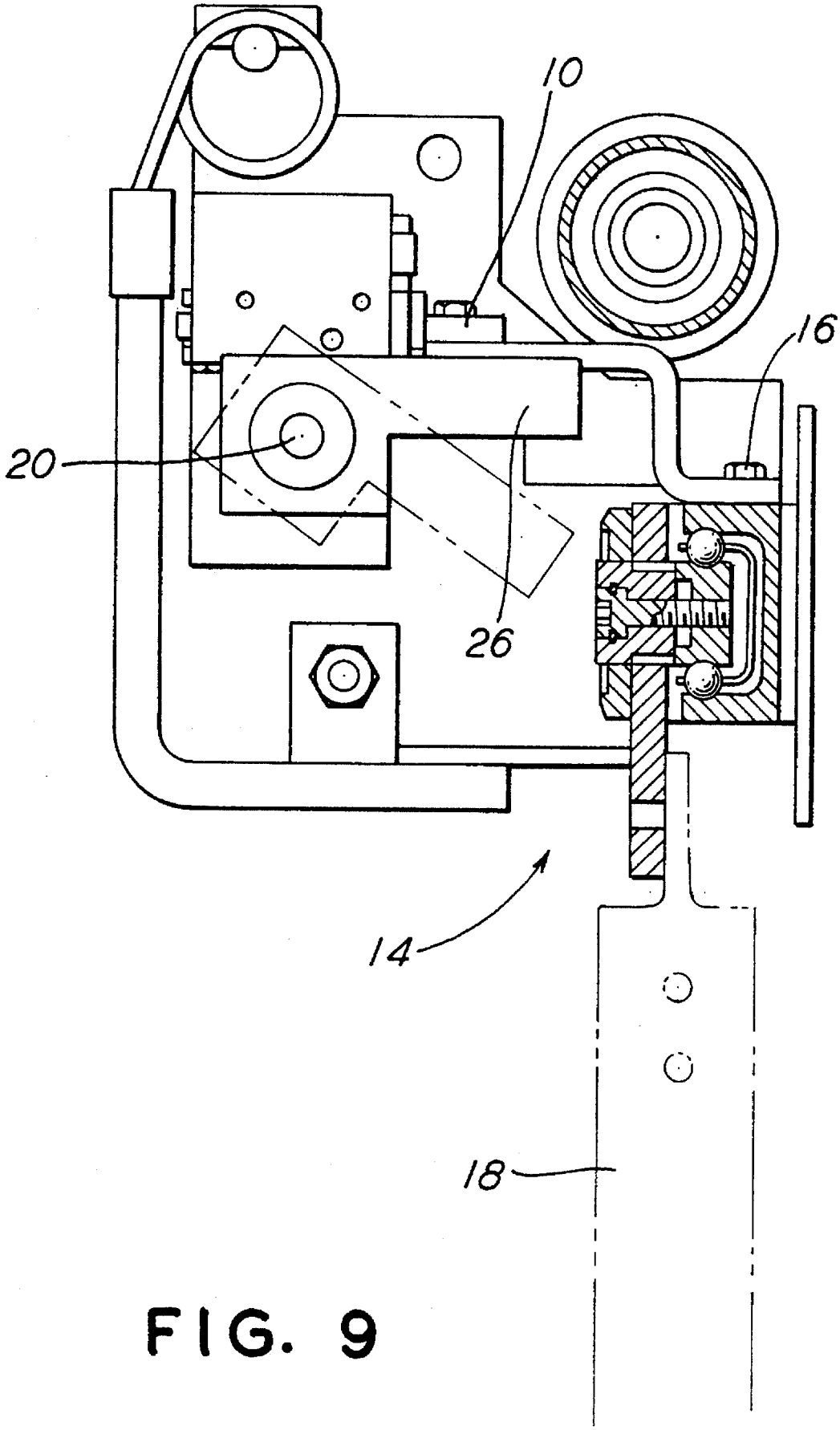
FIG. 9 is a end view of the apparatus as shown in FIGS. 7 and 8.

Referring now to the several drawings, illustrated therein is a service bypass apparatus for an automatic door operator on a passenger transit type railway vehicle pursuant to one preferred embodiment of this invention which comprises a bracket means 10 secured to a flange portion 12 of the overhead automatic door operator 14 with bolts 16 (FIGS. 7, 8 and 9). Bracket means 10 is designed to support a rotatable shaft 20 with bushing 22A pressed into circular opening 24A. Another bushing 22B is pressed into circular opening 24B so that rotatable shaft 20 is rotatably supported at two locations, namely bushings 22A and 22B within circular openings 24A and 24B, respectively.

A blocking lever arm 26 is rigidly positioned at the outside end of shaft 20 adjacent bushing 22A and adapted to be rotatably pivoted when rotatable shaft 20 is partially rotated. The shape and configuration of blocking lever arm 26 is not particularly critical, provided that it is shaped and positioned to abut against some portion of the door panel 18 (FIG. 9), such as a flange, so that it will block the door panel 18 from opening when rotated to it's "service bypass" position, but will not prevent the door panel 18 from opening when rotated back to it's normal position.

A male coupling member 30 and a female coupling member 32 are mounted onto rotatable shaft 20 in a mating relationship adjacent the outside end of bushing 22B, such that the female coupling member 32 is rigidly secured to shaft 20 with set screw 34 adjacent bushing 22B, with torsion spring 36 housed within the two coupling members 30 and 32. Retaining ring 38 is mounted onto shaft 20 to prevent the male coupling member 30 from sliding off of shaft 20 and keep it biased against female coupling member 32.

A pair of cam means 40A and 40B are rigidly attached to rotatable shaft 20 between bushings 22A and 22B with set screws or pins 42 and positioned to activate roller switches 44A and 44B. Roller switches 44A and 44B are attached to bracket means 10 by bolts 46 and nuts 48 (only one of each shown), with bolts 46 inserted through holes 50 in bracket means 10. Insulating plate members 52 are mounted between roller switches 44A and 44B and the sides of bracket means 10 to prevent any possibility of a short circuit. As can be seen, mating holes 54 are provided through roller switches 44A and 44B and insulating plate members 52 through which bolts 46 are inserted to mount the two-switch assembly (i.e., roller switches 44A and 44B) in an aligned arrangement adjacent shaft 20 and adjacent, respective, cam means 40A and 40B.

As should be apparent, roller switches 44A and 44B are of the type that can be switched on and off by a partial rotation of such cam means 40A and 40B respectively adjacent thereto. The two roller switches 44A and 44B are of course wired as necessary to shut off power to the automatic door operator 14; e.g., electrical power and/or pneumatic power, and to disconnect any trainline interlock circuit, and to light up an "Out of Service" sign (not shown) if desired. Obviously, the function performed by roller switches 44A and 44B will depend upon the type of automatic door operator utilized, and must vary, therefore, as necessary to shut off the power source to the automatic door operator 14 and yet permit other automatic door operators to function independently as desired. Accordingly, one, two or a greater number of such roller switches 44 may be necessary in order to accomplish all necessary functions.

Pursuant to one such system to be utilized, two such roller switches 44A and 44B are utilized, as illustrated in the drawings, one of which is adapted to isolate the automatic door operator both electrically and pneumatically from other door operators, and the other is adapted to disconnect the automatic door operator from a trainline interlock circuit and light up a "Out of Service" light (not shown) over the door.

At least one control means must be provided to activate the service bypass apparatus described above, as necessary to isolate the door 18 from the automatic door operator 14. In the preferred embodiment illustrated in the drawings, and particularly FIG. 2, the presently preferred control means, which can be positioned at any convenient location remote from bracket means 10, comprises a cylinder member 60 rotatably mounted within a housing member 70 for partial rotation within a defined angle. While the defined angle of partial rotation of cylinder member 60 can be controlled by any one of a variety of techniques, such control is effected, in the embodiment shown, by positioning a spring loaded ball 62, loaded by compression spring 64, between such cylinder member 60 and a cover plate 72 of housing member 70. A small hole (not shown) is provided in the face of cylinder member 60 which is adapted to receive compression spring 64 and a portion of the spring loaded ball 62.

The inside face of cover plate 72 is provided with a pair of detentes (not shown) adapted to receive spring loaded ball 62, and positioned in an arcuately spaced relationship so that cylinder member 60 can be partially rotated from a first position where such spring loaded ball 62 is engaged with a first detente (not shown), to a second position where the spring loaded ball 62 engages the second detente (not shown). In this way, cylinder member 60 can be partially rotated back and forth within a defined angle, depending upon the spacing of the detentes (not shown), from one "click stop" to the other. Such systems for controlling such a partial rotational movement can vary significantly and are well known, and need not, therefore, be further described in detailed here.

Figure 2:
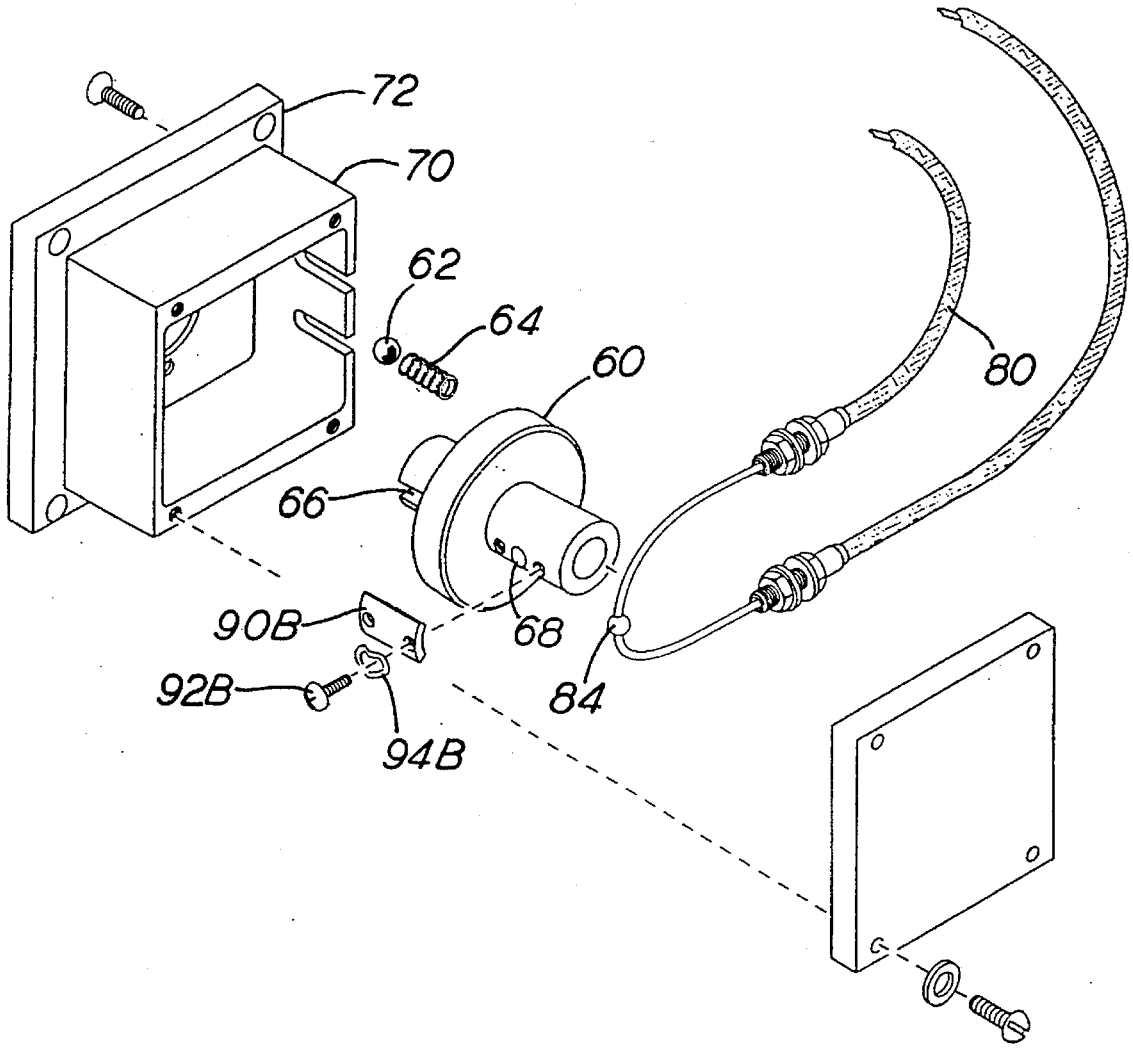
FIG. 2 is an exploded isometric view of one presently preferred embodiment of a control apparatus for controlling the apparatus shown in FIG. 1.
Figure 4:
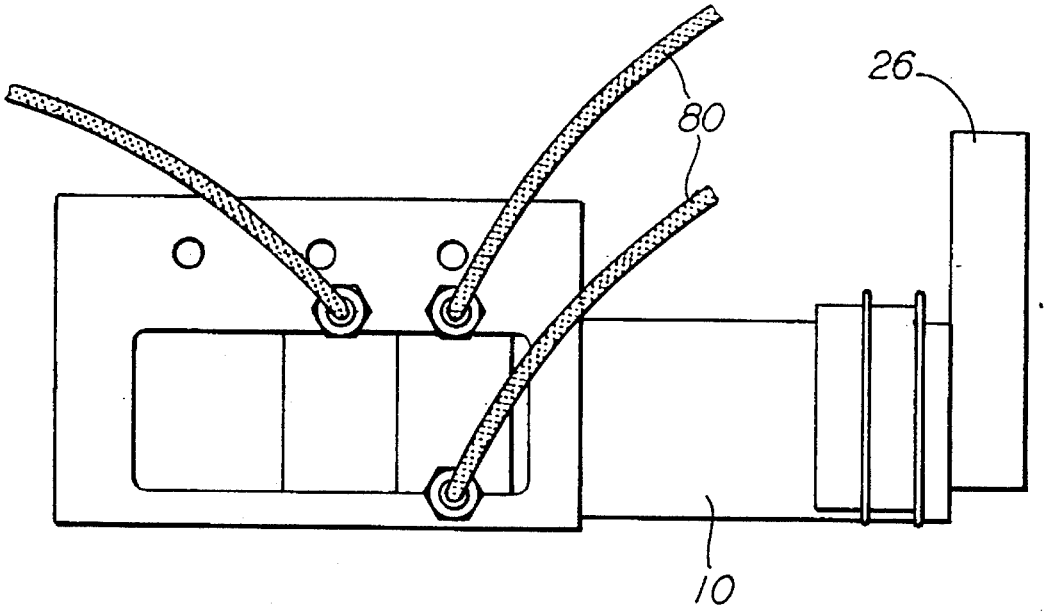
FIG. 4 is plan view of the apparatus as shown in FIG. 3.
Figure 3:
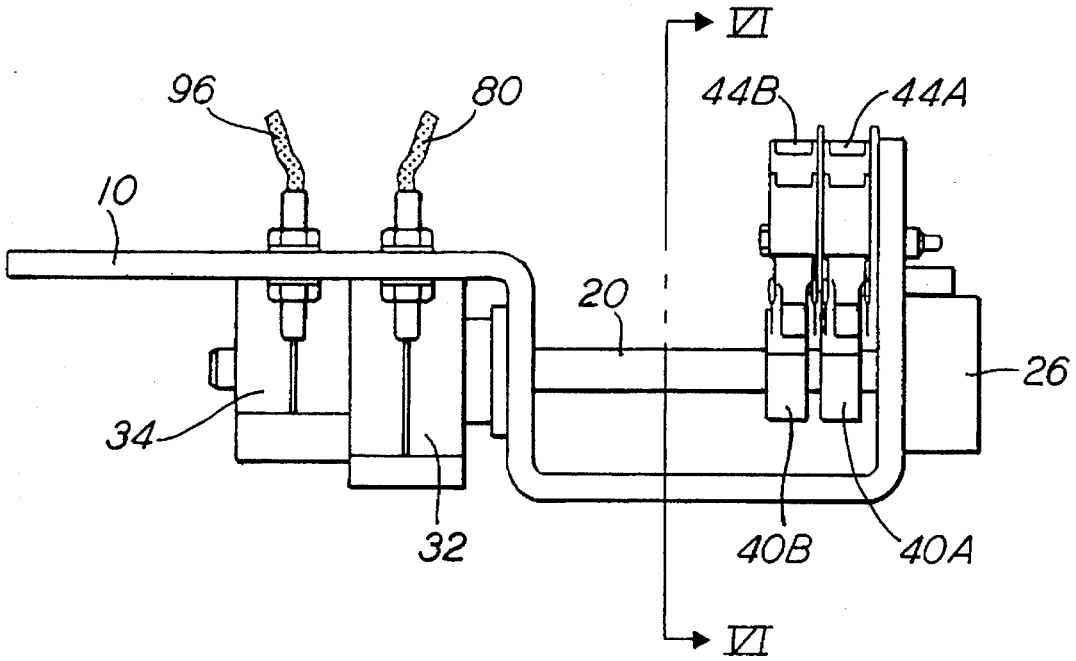
FIG. 3 is an elevational view of the assembled apparatus shown in FIG. 1.
Figure 5:
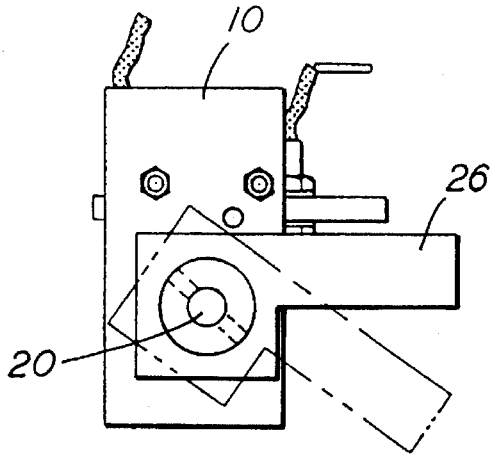
FIG. 5 is an end view of the apparatus as shown in FIGS. 3 and 4.
Figure 6:
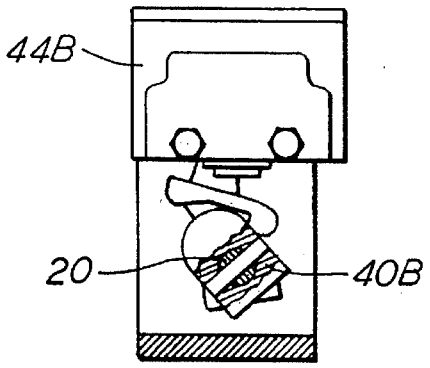
FIG. 6 is a sectional end view of the apparatus as shown in FIGS. 3, 4 and 5 with the section taken at line VI-VI.
Figure 10:
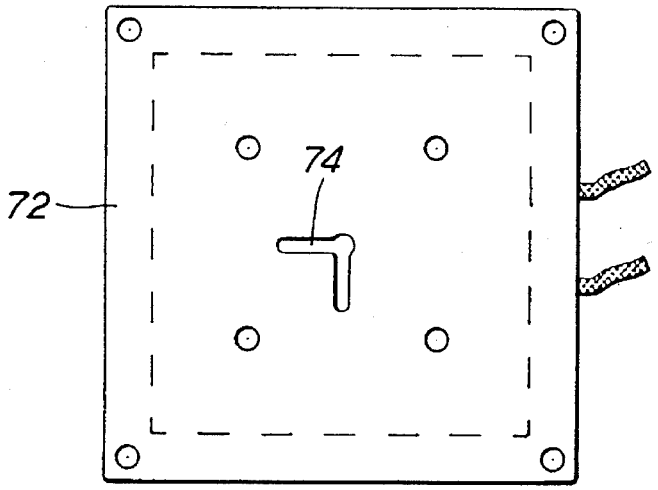
FIG. 10 is an elevational view of the assembled control apparatus shown in FIG. 2 particularly showing the face of one cover plate having a double key slot therein.

As shown in FIG. 10, the cover plate 72 is provided with a double key slot 74 which is aligned with a single key slot 66 in the end of cylinder member 60 (FIG. 2). Accordingly, a key (not shown) similar to a door latch key, can be inserted through one of the double slots 74 to engage single slot 66 in the end of cylinder member 60 and thereby rotate cylinder member 60 through a given angle (90 degrees as shown) which rotation will be controlled by such spring loaded ball 62 moving from one detente (not shown) to the other detente (not shown), and the key removed through the other key slot 74 after such rotation of the cylinder member 60 has been effected. Accordingly, the key (not shown) is adapted to rotate cylinder member 60 back and forth through a given angle as necessary to activate and deactivate the service bypass apparatus as discussed below.

The housing member 70, which contains the remote control apparatus, as partially described above, can be positioned at any convenient location which will permit the cable coupling between housing member 70 and the bypass apparatus and control of the bypass apparatus, as will be hereinafter described. Specifically, a closed-loop, housed cable 80, is provided which has a first exposed ball 82 at one position and a second exposed ball 84 another position. One end of closed-loop cable 80 is secured to bracket means 10 at slots in a manner such that the first exposed ball 82 can be secured to female coupling member 32 within detente 33, using a clamp 90A, screw 92A and waive washer 94A. The other end of closed-loop cable 80 is secured to housing member 70 at slots 74 in a manner such that the second exposed ball 84 is secured to cylinder member 60 at detente, using a clamp 90B, screw 92B and waive washer 94B.

Accordingly, any partial rotation of cylinder member 60 with a key as described above, will cause such closed-loop cable 80 to drive the rotatable shaft 20 through a similar partial rotation. As should be apparent, the angle of the two rotations will not necessarily be the same, but will depend on the comparative radii of rotatable shaft 20 and cylinder member 60 at the point where the two exposed balls 82 and 84 are secured. As should also be readily apparent, however, any such partial rotation of cylinder member 60 with a key as described above, must necessarily be sufficient to cause such rotatable shaft 20 to undergo a partial rotation which is at least sufficient to activate the service bypass apparatus as necessary to isolate the door from the automatic door operator 14 as also described above.

A means for manually resetting the automatic door operator 14 is provided by including a simple length of housed cable 96 having a ball 98 disposed at one end thereof. Housed cable 96 is secured to bracket means 10 at slot 19 so that ball 98 can be secured to the male coupling member 30 within a detente (not shown), using a clamp 90C, screw 92C and waive washer 94C. The other end of such housed cable 96 is provided with a handle means 99 which should be exposed and positioned such that anyone can pull on cable 96 to reset the automatic door operator 14 if necessary.

As can be seen, if one were to pull on cable 96 with a force sufficient to cause partial rotation of male coupling member 30, a comparable rotation of rotatable shaft 20 would result, and accordingly, blocking lever arm 26 will be pivoted out of the way as necessary to permit the door to open, as well as rotate such cam means 40A and 40B as necessary to reset roller switches 44A and 44B to provide power to the automatic door operator 14 and shut off the "Out of Service" light, to effectively reset the entire bypass apparatus.

While a presently preferred embodiment of the service bypass apparatus according to the present invention has been described in detail above, it should be readily apparent to those persons who are skilled in the automatic door opening art that various other embodiments, adaptations and modifications of the invention could be made without departing from either the spirit or the scope of the invention.

For example, while the above described embodiment is described as utilized in combination with a single access door panel of the sliding type, it should be apparent that the inventive apparatus could be adapted for use on other types of door panels, including double door panels and even folding single and double door panels. For example, for use with double door panels, a pair of blocking lever arms 26 may have to be provided.

With regard to the control apparatus as has been illustrated in FIG. 2, it should be quite apparent that the apparatus described is but one of a significant number of variations that could be devised and designed, as the only requirement is that some means be provided to cause a partial rotation of such rotatable shaft 20, as necessary, to pivotally rotate blocking lever arm 26 into a position sufficient to block the door panel from opening and activate the roller switch or switches 44A and 44B. It should, also, be quite apparent that a great number of different devices could be designed to accomplish this purpose, which could even include solid state electronic means.

While the roller switches 44A and 44B have been described to perform specific functions for a specific automatic door operator system, it should be apparent that any type of automatic door operator can be bypassed by merely causing the switches 44A and 44B to either activate or deactivate whatever is necessary to effectively bypass the system without bypassing all of the door operators disposed on the vehicle. Clearly, therefore, other variations, embodiments, adaptations and modifications could be made without departing from the spirit and scope of the present invention, as defined by the appending claims.

We claim:

1. A service bypass apparatus for use in combination with a passenger access door on a passenger transit vehicle, wherein such passenger access door is opened and closed by a remotely operated automatic door operator activated by a source of energy supplied thereto via a conduit means, said service bypass apparatus adapted to isolate such automatic door operator from such source of energy and lock such door in a closed position, said service bypass apparatus comprising:

(a) a shaft rotatably secured to a bracket means;

(b) a blocking lever arm, a first end of which is rigidly secured to said shaft and a second end of which is adapted, upon partial rotation of said shaft, to be pivoted into a position sufficient to block such door from opening;

(c) a switch means on such conduit means adapted to disconnect such source of energy from such automatic door operator;

(d) at least one cam means rigidly secured to said shaft and adapted, upon partial rotation of said shaft, to activate said switch means as necessary to disconnect such source of energy from such automatic door operator; and (e) at least one control means to partially rotate said shaft sufficient to simultaneously:

(i) pivot said blocking lever arm into said position sufficient to block such door opening, and (ii) pivot said at least one cam means into position sufficient to activate said switch means as necessary to disconnect such source of energy from such automatic door operator.

2. A service bypass apparatus, according to claim 1, wherein said at least one control means to partially rotate said shaft is further adapted to selectively rotate said shaft back to it's original position.

3. A service bypass apparatus, according to claim 2, wherein said at least one control means includes a rotatable cylinder means which is physically interconnected to said shaft with a closed-loop cable in a manner such that any rotational movement of said rotatable cylinder means will cause said shaft to undergo a similar rotation, and a second cable is provided which can be manually pulled to rotate said shaft back to it's original position.

4. A service bypass apparatus, according to claim 3, wherein said shaft is provided with a rigidly secured coupling to which said closed-loop cable is attached.

5. A service bypass apparatus, according to claim 3, wherein said shaft is provided with a rigidly secured female coupling to which said closed-loop cable is attached, and said second cable is attached to a male coupling in a spring loaded engagement with said female coupling.

6. A service bypass apparatus, according to claim 1, wherein said at least one switch means adapted to disconnect any energy supply to said automatic door operator and effectively bypass said automatic door operator, is adapted to isolate said automatic door operator electrically and pneumatically from other door operators, and further adapted to disconnect said automatic door operator from any trainline interlock circuit.

7. A service bypass apparatus, according to claim 1, wherein said at least one switch means is further adapted to light an "Out of Service" sign.

8. A service bypass apparatus, according to claim 1, wherein said at least one switch means is a roller switch.

9. A service bypass apparatus, according to claim 1, wherein said at least one control means for partially rotating said shaft is disposed at a physically remote location from said shaft and functions through a remote control means interconnecting said shaft and said at least one control means.

10. A service bypass apparatus, according to claim 9, wherein said remote control means comprises at least one cable.

11. A service bypass apparatus, according to claim 1, wherein said at least one control means includes a rotatable cylinder means which is physically interconnected to said shaft in a manner such that any rotational movement of said rotatable cylinder means will cause said shaft to undergo a similar rotation.

12. A service bypass apparatus, according to claim 11, wherein said rotatable cylinder means and said shaft are interconnected with a closed-loop cable in a manner such that any partial rotation of said rotatable cylinder means will translate into a partial rotation of said shaft.

13. A service bypass apparatus, according to claim 11, wherein said rotatable cylinder means is adapted to rotate said shaft as necessary to isolate said access door from said automatic door operator, as well as rotate said shaft back to it's original position to reengage said access door with said automatic door operator.

14. A service bypass apparatus, according to claim 13, wherein said rotatable cylinder means is rotatable with a removable key.

15. A service bypass apparatus, according to claim 1, wherein said bracket means is adapted to be secured to said automatic door operator.

16. A service bypass apparatus, according to claim 1, wherein said access door is provided with a rigidly secured flange against which said blocking lever arm can be positioned when said shaft is partially pivoted to block said access door from opening.

17. A service bypass apparatus for use in combination with a passenger access door on a passenger transit vehicle, wherein such passenger access door is opened and closed by a remotely operated automatic door operator activated by a source of energy supplied thereto via a conduit means, said service bypass apparatus adapted to isolate such automatic door operator from such source of energy and lock such door in a closed position, said service bypass apparatus comprising:

(a) a shaft rotatably secured to a bracket means;

(b) a blocking lever arm, a first end of which is rigidly secured to said shaft and a second end of which is adapted, upon partial rotation of said shaft, to be pivoted into a position sufficient to block such door from opening;

(c) a switch means adapted to disconnect such source of energy from such automatic door operator;

at least one cam means rigidly secured to said shaft and adapted upon, partial rotation of said shaft, to activate said switch means as necessary to disconnect such source of energy from such automatic door operator;

(e) a first control means to partially rotate said shaft sufficient to simultaneously:

(i) pivot said blocking lever arm into said position sufficient to block such door from opening, and (ii) pivot said at least one cam means into position sufficient to activate said switch means as necessary to disconnect such source of energy from such automatic door operator; and (f) a second control means adapted to selectively rotate said shaft back to its original position.

18. A service bypass apparatus for use in combination with a passenger access door on a passenger transit vehicle, wherein such passenger access door is opened and closed by a remotely operated automatic door operator activated by a source of energy supplied thereto via a conduit means, said service bypass apparatus adapted to isolate such automatic door operator mechanically, electrically and pneumatically from such source of energy and lock such access door in a closed position, said service bypass apparatus comprising:

(a) a bracket means;

(b) a shaft rotatably secured to said bracket means;

(c) a blocking lever arm, a first end of which is rigidly secured to said shaft and a second end of which is adapted, upon partial rotation of said shaft, to be pivoted into a position sufficient to block such access door from opening;

(d) at least one cam means rigidly secured to said shaft and adapted, upon partial rotation of said shaft, to:

(i) activate a first switch means adapted to disconnect such source of energy electrically and pneumatically from such automatic door operator, and (ii) activate a second switch means adapted to disconnect such automatic door operator from a trainline interlock circuit;

(e) at least one control means to partially rotate said shaft sufficient to simultaneously:

(i) pivot said blocking lever arm into said position sufficient to block such access door from opening, and (ii) pivot said at least one cam means into position sufficient to activate said first and second switch means, and after such pivotal action has been effected, capable of rotating said shaft in an opposite direction to simultaneously:

(A) pivot said blocking lever arm into a position insufficient to block such access door from opening, and (B) pivot said at least one cam means into position insufficient to activate said first and second switch means.

19. A service bypass apparatus, according to claim 18, further including an independent second control means for rotating said shaft in said opposite direction to simultaneously:

(i) pivot said blocking lever arm into a position insufficient to block said access door from opening, and (ii) pivot said at least one cam means into position insufficient to activate said first and second switch means.

20. A service bypass apparatus, according to claim 19, wherein said second control means can be manually operated without need for any special equipment.

* * * * *

UNITED STATES PATENT AND TRADEMARK OFFICE

CERTIFICATE OF CORRECTION

PATENT NO. : 5,460,100

DATED : October 24, 1995

INVENTOR(S) : Padmanab L. Gowda et al.

It is certified that error appears in the above-indentified patent and that said Letters Patent is hereby corrected as shown below:

Column 5, line 60, after "slots", insert --17--;

column 5, line 65, after "detente", insert --68--.

Column 8, line 59, before "at", insert --(d)--;

column 8, line 60, after "adapted", insert ",";

column 8, line 60, after "upon", delete ",".

Signed and Sealed this

Ninth Day of January, 1996

Bruce Lehman

*Attest:*

BRUCE LEHMAN

*Attesting Officer*

*Commissioner of Patents and Trademarks*